US009557712B2

(12) United States Patent
Rochat et al.

(10) Patent No.: US 9,557,712 B2
(45) Date of Patent: Jan. 31, 2017

(54) ANNULAR OSCILLATING WEIGHT AND TIMEPIECE COMPRISING SUCH AN OSCILLATING WEIGHT

(71) Applicant: Blancpain S.A., Le Brassus (CH)

(72) Inventors: Marco Rochat, Le Brassus (CH); Samuel Cordier, Gex (FR)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/930,746

(22) Filed: Nov. 3, 2015

(65) Prior Publication Data

US 2016/0139563 A1 May 19, 2016

(30) Foreign Application Priority Data

Nov. 14, 2014 (EP) ..... 14193348

(51) Int. Cl.

| | |
|---|---|
| ***G04B 5/18*** | (2006.01) |
| ***G04B 5/04*** | (2006.01) |
| ***G04B 5/16*** | (2006.01) |
| ***G04B 43/00*** | (2006.01) |

(52) U.S. Cl.

CPC ..... *G04B 5/04* (2013.01); *G04B 5/165* (2013.01); *G04B 5/184* (2013.01); *G04B 5/188* (2013.01); *G04B 43/002* (2013.01)

(58) Field of Classification Search

CPC ..... G04B 5/16; G04B 5/00; G04B 5/165; G04B 5/10; G04B 5/12; G04B 5/04; G04B 5/184; G04B 5/188; G04B 43/002

See application file for complete search history.

(56) References Cited

U.S. PATENT DOCUMENTS

| | | | | |
|---|---|---|---|---|
| 2,746,238 A * | 5/1956 | Heinrich Stamm | ..... | G04B 5/16 368/208 |
| 2,936,571 A * | 5/1960 | Biemiller | ..... | G04C 3/06 368/162 |
| 5,012,838 A * | 5/1991 | Kawase | ..... | F02M 25/0836 123/516 |
| 6,120,177 A * | 9/2000 | Hara | ..... | G04B 5/16 368/149 |

(Continued)

FOREIGN PATENT DOCUMENTS

| | | |
|---|---|---|
| CH | 281 490 | 3/1952 |
| CH | 286 915 | 11/1952 |

(Continued)

OTHER PUBLICATIONS

European Search Report issued Sep. 4, 2015 in European Application 14193348, filed on Nov. 14, 2014 ( with English Translation).

*Primary Examiner* — Sean Kayes
(74) *Attorney, Agent, or Firm* — Oblon, McClelland, Maier & Neustadt, L.L.P.

(57) ABSTRACT

The oscillating weight includes a drive ring and a heavy sector. The drive ring includes an annular transmission portion which has a coaxial toothing and a second annular portion concentric to the annular transmission portion, the heavy sector being fixed to the second annular portion. The drive ring further includes a plurality of connecting elements which are elastically deformable and which connect the annular transmission portion to the second annular portion.

14 Claims, 3 Drawing Sheets

(56) References Cited

U.S. PATENT DOCUMENTS

| | | | | |
|---|---|---|---|---|
| 6,666,575 | B2 * | 12/2003 | Scheufele | G04B 18/006 368/127 |
| 8,439,556 | B2 * | 5/2013 | Queval | G04B 13/022 368/127 |
| 8,662,742 | B2 * | 3/2014 | Damasko | G04B 17/063 368/171 |
| 2009/0257322 | A1 | 10/2009 | Courvoisier et al. | |
| 2010/0054089 | A1 * | 3/2010 | Maier | B81C 99/0085 368/169 |
| 2016/0059452 | A1 * | 3/2016 | Strahm | G04B 5/165 264/255 |

FOREIGN PATENT DOCUMENTS

| | | | |
|---|---|---|---|
| CH | 701 343 | B1 | 1/2011 |
| EP | 2 110 719 | A1 | 10/2009 |

* cited by examiner

ANNULAR OSCILLATING WEIGHT AND TIMEPIECE COMPRISING SUCH AN OSCILLATING WEIGHT

This application claims priority from European patent application No. 14193348.1 filed Nov. 14, 2014, the entire disclosure of which is hereby incorporated herein by reference.

FIELD OF THE INVENTION

The present invention concerns an annular oscillating weight comprising a drive ring including an annular transmission portion provided with a toothing coaxial to the ring, and a heavy sector secured to the drive ring. The present invention also concerns a timepiece movement and a self-winding timepiece which respectively comprise the annular oscillating weight of the invention.

PRIOR ART

There are known self-winding watches equipped with an annular oscillating weight. This oscillating weight is accommodated in a circular passage provided around the movement inside the watch case. Bearing rollers are also arranged at the side of the passage to support and guide the oscillating weight, so that it is free to rotate inside the passage. The drive ring may, for example, have an inner toothing, by means of which the rotational movements of the oscillating weight are mechanically transmitted to the barrel of the movement. The oscillating weight thus ensures the self-winding of the mainspring.

The function of the bearing rollers is to guide the ring and to limit friction as much as possible. To this end, they are preferably mounted on ball bearings. To provide a stable base for the oscillating weight, the bearing rollers must be at least three in number. A known problem with annular oscillating weights matching the above description relates to the relative fragility of the rollers in view of the considerable inertia of the oscillating weight. Indeed, in the event of a radially exerted shock on the timepiece case middle, the considerable weight of the oscillating weight may, for example, lead to rupture of the arbor of the bearing rollers, or alternatively cause the ball bearings to seize up. Further, in the event of a shock on the back cover side or the dial side of the timepiece, the axial motion of the oscillating weight risks damaging the toothed wheel which meshes with the drive ring.

In order to at least partially overcome the aforementioned problems, CH Patent No 701343B1 proposes to mount each of the bearing rollers on a damper member preferably formed by a spring loaded lever. The function of the damping members is to dampen any inadvertent motion of the oscillating weight in the radial direction following a shock. It will be understood, however, that the solution proposed by the aforementioned Patent document does not enable motions of the oscillating weight to be damped in the axial direction.

BRIEF SUMMARY OF THE INVENTION

It is an object of the present invention to overcome the problems of the prior art that have just been described. This object is achieved by providing an annular oscillating weight in accordance with the annexed claim 1.

According to the invention, the annular transmission portion of the drive ring and the heavy sector are directly or indirectly connected to each other. Further, the connection between the annular transmission portion and the heavy sector is achieved by means of a plurality of elastically deformable connecting elements. It will be understood, therefore, that in the event of shock, the heavy sector has the possibility of moving away from its normal trajectory to a certain point without the annular transition portion being forced to do the same regardless of whether the motion of the weight after the shock is radial or axial. The coaxial toothing is carried by the annular transmission portion and it will therefore be understood that the presence of deformable connecting elements to a certain extent allows the heavy sector to be mechanically uncoupled from the coaxial toothing. In particular, when a shock causes a sudden acceleration of the heavy sector, the deformable connecting elements can dampen this acceleration, and thereby prevent the gear arrangement between the drive ring and the winding device being damaged.

According to an advantageous embodiment of the invention, the elastically deformable connecting elements are formed by flexible elastic pins. This feature gives the heavy sector the possibility of moving away from its normal trajectory in all directions relative to the annular transmission portion. According to an advantageous variant of this embodiment, the longitudinal arbors of the flexible rods preferably extend in the same plane parallel to the drive ring. One advantage of this feature is that the rods oppose the same return force to an upward axial force as to a downward axial force.

According to an advantageous embodiment, the flexible rods exhibit at least one fork. According to a first variant of this particular embodiment, the rods have a general Y-shape with a single fork. According to a second variant, the rods fork in two places, on either side of the middle of the pin. In other words, according to the second variant, the rods include two opposite forks which give them a general double Y-shape. According to either of the latter two variants, the forked portions of the rods are preferably also contained in the plane parallel to the drive ring in which the longitudinal arbor extends. As will be seen in more detail below, the fact that the branches have forks contained in a plane parallel to the drive ring has the advantage of increasing the return force in the event of force in a tangential direction to the ring.

The invention also includes a self-winding timepiece movement according to claim 10 of the Patent and a self-winding timepiece according to claim 11 of the Patent.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF EMBODIMENTS

Figure 1:
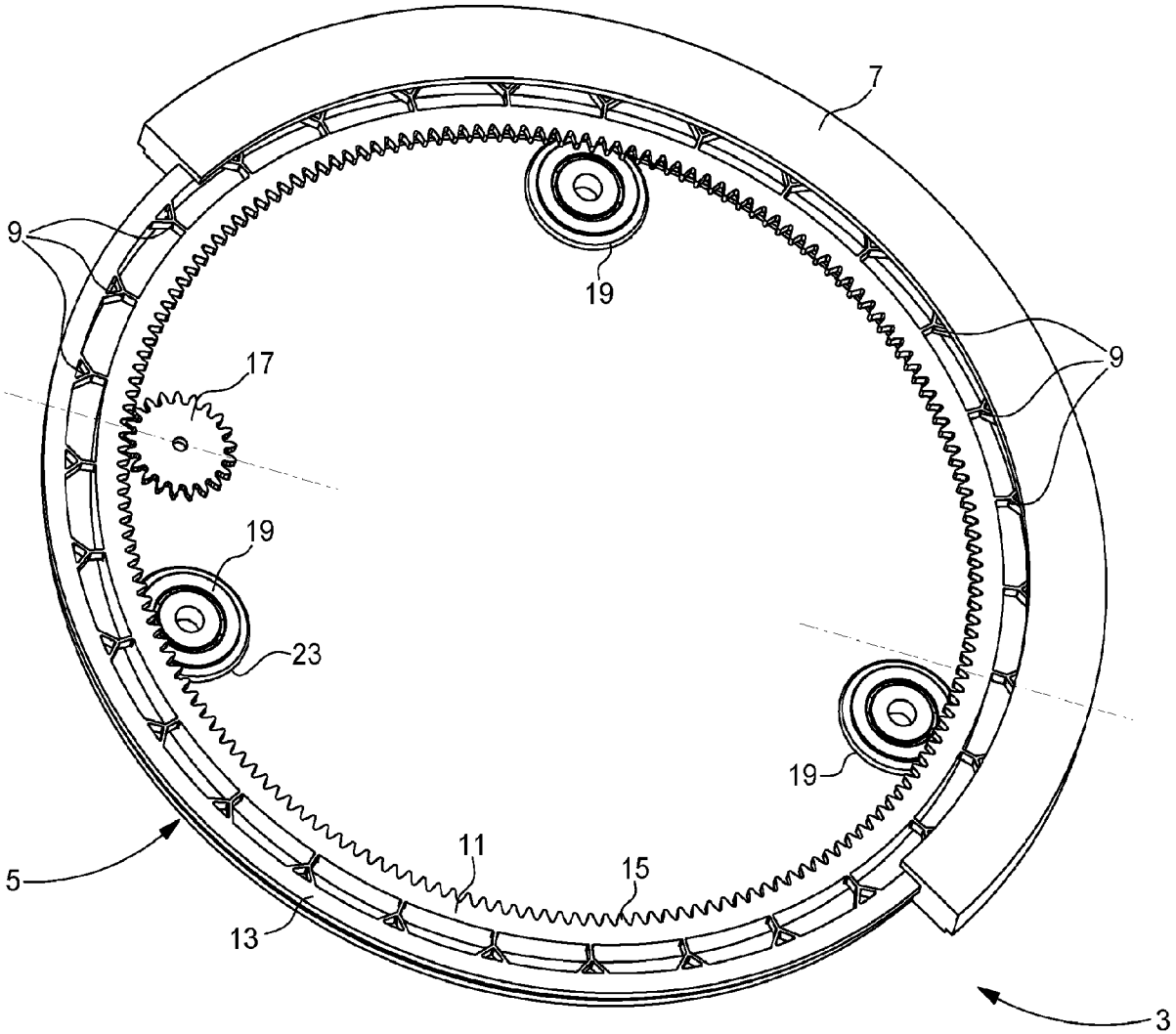
FIG. 1 is a perspective view from the back cover side of a timepiece showing an annular oscillating weight corresponding to a particular embodiment of the invention, and a winding wheel set and three bearing rollers arranged to cooperate with the oscillating weight.

FIG. 1 is a perspective view of an annular oscillating weight 3 according to a first embodiment of the invention.

The oscillating weight shown includes a drive ring 5 and a heavy sector 7. According to the invention, the drive ring includes a plurality of elastic deformable connecting elements 9 which extend between an annular transmission portion 11 and a second annular portion 13. As shown in the Figure, heavy sector 7 is carried by and integral with the second annular portion, whereas the annular transmission portion has a concentric inner toothing 15.

Referring to FIG. 1 again, it can be seen that, in the embodiment illustrated, elastically deformable connecting elements 9 take the form of rods arranged parallel to the plane of drive ring 5. These rods each have a fork giving them a Y-shape whose upper portion faces second annular portion 13. It may be noted that in the embodiment illustrated, the longitudinal arbor of the rods is oriented radially and that the branches of the fork diverge away from the longitudinal arbor in a parallel plane to the drive ring and are integral with second annular portion 13. Rods 9 are flexible so that they can deform in the event of a shock. Those skilled in the art will understand that the rods shown are arranged to allow second annular portion 13 to move away from its position of equilibrium relative to annular transmission portion 11 in all three directions, (axial, radial and tangential).

Figure 2:
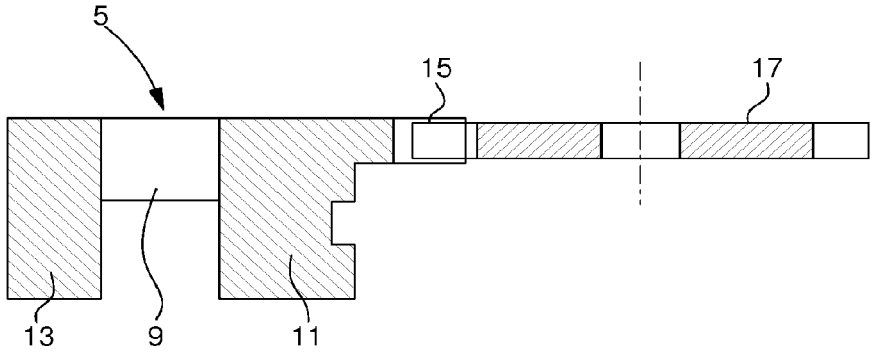
FIG. 2 is sectional view along the line A-A of FIG. 1.

The oscillating weight 3 shown in FIG. 1 forms part of a self-winding timepiece of which only one winding wheel set 17 and three bearing rollers 19 are illustrated. As can be seen in FIG. 1 and in the sectional view of FIG. 2, winding wheel set 17 includes a toothed wheel which meshes with inner toothing 15 of drive ring 5. In a known manner, the function of the winding wheel set is to transmit the rotational motions of the oscillating weight to the winding mechanism (not shown) in order to wind the mainspring.

Figure 3:
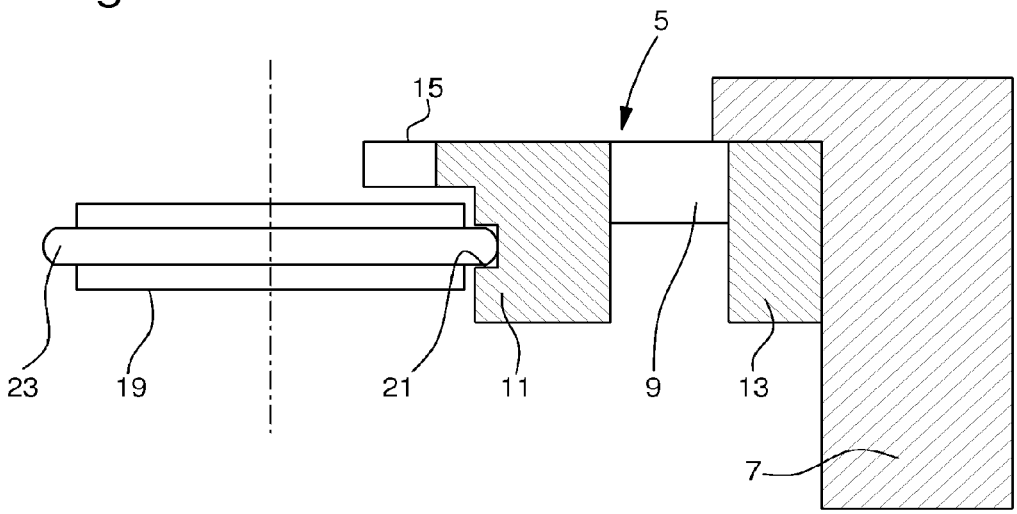
FIG. 3 is a sectional view along the line B-B of FIG. 1.

Bearing rollers 19 are preferably equipped with ball bearings (not shown). The function of the bearing rollers is to support and guide the oscillating weight, so that it is free to rotate about the circle passing through the three ball bearings. Referring more particularly to the sectional view of FIG. 3, it can be seen that annular transmission portion 11 of drive ring 5 has an annular groove 21. Groove 21 is arranged to cooperate with an equatorial bulge 23 in the circumference of bearing rollers 19. It can be seen that bulge 23 penetrates groove 21. It will be understood that this arrangement ensures the axial positioning of the annular oscillating weight.

As already stated, according to the invention, oscillating weight 3 of the present example is arranged for damping shocks. First of all, it is well known that when a small object such as a watch receives a shock, it undergoes a sudden acceleration in the direction of the shock. In the case which concerns us, where the object in question is the timepiece of the present example, the sudden acceleration of the timepiece is transmitted to the oscillating weight which it contains by means of bearing rollers 19. Since the inertia of oscillating weight 3 is essentially localised in heavy sector 7, the latter exerts a considerable inertial force on the rest of the oscillating weight. In the case where this inertial force is oriented in the radial direction (parallel to the plane of drive ring 5 and in the direction of the axis of rotation of the oscillating weight), it produces a motion of annular portion 13 relative to annular transmission portion 11 in the plane of the drive ring. It will be understood that, according to the invention, this motion is made possible by the deformation of the connecting elements (in the present example, the bending deformation of rods 9 or their fork), and that this motion contributes to damping the shock, and in particular to protecting the ball bearings of rollers 19.

In the case where the inertial force is exerted by heavy sector 7 in a tangential direction (in a direction tangent to drive ring 5 and parallel to the plane of the ring), the inertial force tends to suddenly rotate second annular portion 13 of drive ring 5. It will be understood that, according to the invention, this sudden movement can be damped by means of the bending deformation of rods 9. The flexible rods prevent the torque exerted by inner toothing 15 on the winding wheel set exceeding an admissible value. Any breakage of the self-winding mechanism can therefore be avoided.

It was seen that bearing rollers 19 are arranged to hold oscillating weight 3 not only radially, but also axially as a result of the cooperation between equatorial bulge 23 and groove 21. The bearing rollers thus also transmit to the oscillating weight the acceleration produced by an axial shock exerted on the back cover side or dial side of the timepiece. In such case, the heavy sector exerts a considerable inertial force in the axial direction (perpendicular to the plane of the drive ring) on the rest of the oscillating weight. This force produces a motion of second annular portion 13 relative to annular transmission portion 11. This motion is oriented perpendicularly to the plane of drive ring 5. It will be understood that, as previously, this motion is made possible by the bending of rods 9, and that this motion protects the bearing rollers and the winding wheel set by damping the shock experienced by the timepiece.

Figure 4A:
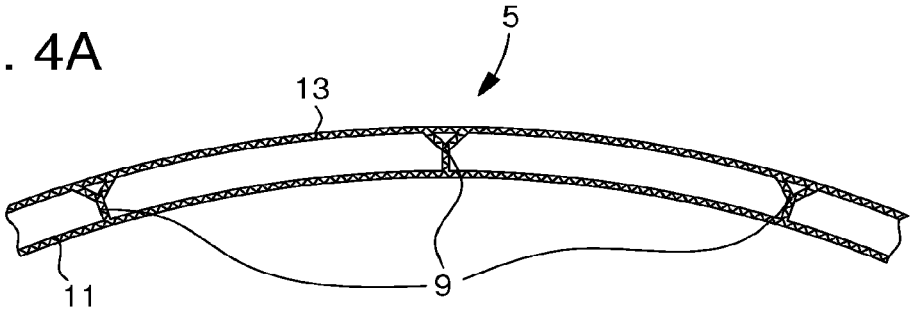
FIGS. 4A, 4B and 4C illustrate three embodiments of the elastically deformable connecting elements of annular oscillating weights of the invention.
Figure 4B:
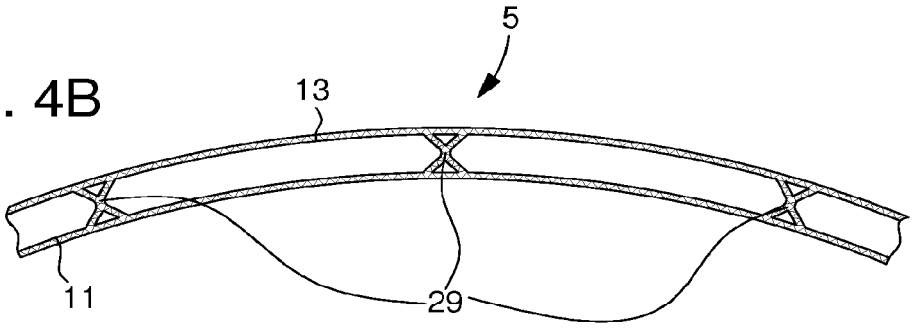
Figure 4C:
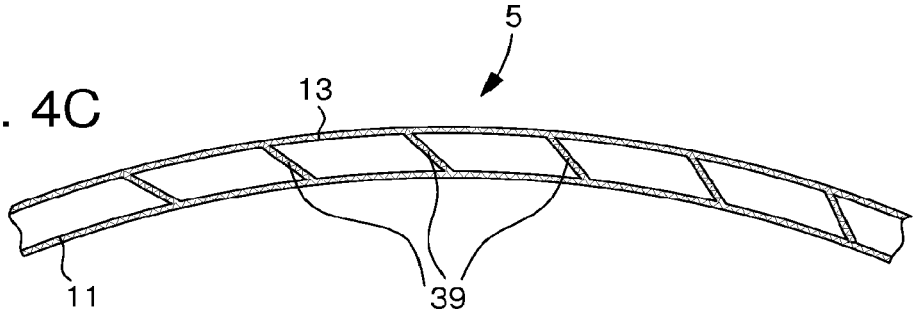

FIGS. 4A, 4B and 4C illustrate schematic views of three embodiments of the elastically deformable connecting elements. The embodiment illustrated in FIG. 4A corresponds to that of the example that has just been described. FIGS. 4B and 4C illustrate two other embodiments in which the connecting elements are also formed by flexible rods arranged to deform elastically. Referring now to FIG. 4B, it can be seen that the flexible rods shown (referenced 29) each include a middle, an inner end and an outer end. It can be seen that the flexible rods are divided into two on either side of the middle towards each of the ends. This feature gives the rods a double Y-shape. Preferably, the two forks of the double-Y are each comprised in plane parallel to drive ring 5. Finally, it can be seen that flexible rods 39 of the FIG. 4C embodiment have a longitudinal arbor which is not oriented in the radial direction but that they form a non-zero angle with the radius of second annular portion 13 passing through the point of attachment of said radius.

It will also be clear that various alterations and/or improvements evident to those skilled in the art may be made to the embodiment forming the subject of the present description without departing from the scope of the present invention defined by the annexed claims. In particular, rather than being arranged around the annular transmission portion, according to a variant, the second annular portion could be disposed concentrically to the inside of the annular transmission portion. Further, the elastically deformable connecting elements are not necessarily formed by flexible pins. Indeed, these connecting elements could alternatively be formed by levers (three or more in number) each associated with a spring.

The drive ring of the invention may be formed from a material including silicon, namely, for example single crystal silicon, polycrystalline silicon, doped single crystal silicon, doped polycrystalline silicon, doped or undoped silicon carbide, doped or undoped silicon nitride, doped or undoped silicon oxide such as quartz or silica. Anisotropic etching of such materials may be achieved by wet means or by dry means and typically by deep reactive ion etching or DRIE.

Alternatively, the drive ring of the invention may be formed of precious or non-precious metal, typically by the electroforming technique known by the abbreviation L.I.G.A. from the German term 'RöntgenLithographie, Galvanoformung & Abformungand' wherein a mould is filled to one or more levels with the aid of a metal, for example, by means of electroplating. Of course, any type of electroforming process capable of forming a one-piece drive ring with one or more levels may be envisaged, whether or not it is of the L.I.G.A. type.

What is claimed is:

1. An annular oscillating weight for a self-winding timepiece, comprising:

a drive ring including an annular transmission portion provided with a coaxial toothing to drive the winding of the timepiece, and including a heavy sector secured to the drive ring; wherein the drive ring further includes a plurality of elastically deformable connecting elements, the heavy sector being connected to the annular transmission portion via the connecting elements, and wherein the annular transmission portion provided with the coaxial toothing and the elastically deformable connecting elements are movable relative to each other in a same plane that extends in a radial direction of the drive ring.

2. The annular oscillating weight according to claim 1, wherein the deformable connecting elements are formed by flexible rods arranged to deform elastically.

3. The annular oscillating weight according to claim 2, wherein the flexible rods each have a longitudinal arbor, and the longitudinal arbors extend in the same plane.

4. The annular oscillating weight according to claim 3, wherein the flexible rods each include a fork giving them substantially a Y-shape, the fork being comprised in the same plane.

5. The annular oscillating weight according to claim 3, wherein the flexible rods each include a middle, an inner end and an outer end, the flexible rods being divided into two on either side of the middle towards each of said ends, the flexible rods substantially having a double Y-shape, the double Y including two opposite forks each comprised in the same plane.

6. The annular oscillating weight according to claim 3, wherein, in an absence of external stress, the longitudinal arbor of each of the flexible rods is oriented radially.

7. The annular oscillating weight according to claim 3, wherein the longitudinal arbor of each of the flexible rods is non-radial.

8. The annular oscillating weight according to claim 2, wherein the drive ring includes a second annular portion concentric to the annular transmission portion, the flexible rods being integral with the annular transmission portion and with the second annular portion and the heavy sector being secured to the second annular portion.

9. The annular oscillating weight according to claim 8, wherein, in an absence of external stress, the second annular portion extends concentrically about the annular transmission portion and in the same plane.

10. The annular oscillating weight according to claim 1, wherein the annular transmission portion provided with the coaxial toothing includes the coaxial toothing on an inner circumferential surface of the annular transmission portion.

11. The annular oscillating weight according to claim 1, wherein the annular transmission portion provided with the coaxial toothing includes a groove that is engageable with at least one bearing roller.

12. The annular oscillating weight according to claim 11, wherein the groove is on a same side of the annular transmission portion as the coaxial toothing.

13. A self-winding timepiece movement comprising:

an oscillating weight including an annular transmission portion provided with a coaxial toothing to drive the winding of the timepiece, and including a heavy sector secured to a drive ring; wherein the drive ring further includes a plurality of elastically deformable connecting elements, the heavy sector being connected to the annular transmission portion via the connecting elements, and a self-winding mechanism including a winding wheel set arranged to mesh with the coaxial toothing, and at least three bearing rollers mounted to pivot on a fixed element of the timepiece, the bearing rollers being arranged to cooperate with the annular transmission portion of the drive ring so that the oscillating weight is free to rotate, suspended and guided by the bearing rollers.

14. A self-winding timepiece comprising:

a timepiece movement including an oscillating weight including an annular transmission portion provided with a coaxial toothing to drive the winding of the timepiece, and including a heavy sector secured to a drive ring; wherein the drive ring further includes a plurality of elastically deformable connecting elements, the heavy sector being connected to the annular transmission portion via the connecting elements, and a self-winding mechanism including a winding wheel set arranged to mesh with the coaxial toothing, and at least three bearing rollers mounted to pivot on a fixed element of the timepiece, the bearing rollers being arranged to cooperate with the annular transmission portion of the drive ring so that the oscillating weight is free to rotate, suspended and guided by the bearing rollers.

* * * * *